United States Patent [19]

Bommes

[11] 3,970,499

[45] July 20, 1976

[54] METHOD FOR THE APPLICATION OF GLUED LABELS TO BOTTLES OR THE LIKE

[75] Inventor: Willi Bommes, Dusseldorf, Germany

[73] Assignee: Jagenberg Werke AG, Dusseldorf, Germany

[22] Filed: May 15, 1974

[21] Appl. No.: 469,716

[30] Foreign Application Priority Data

May 15, 1973 Germany ..... 2324412

[52] U.S. Cl. ..... 156/227; 156/443; 156/538

[51] Int. Cl.[2] ..... B65B 45/00; B65C 9/08

[58] Field of Search ..... 156/212, 215, 217, 227, 156/447, 458, 475, 476, 477 R, 479, 480, 481, 492, 566, 567, 568, 571, DIG. 13, DIG. 14, DIG. 15, DIG. 16, DIG. 30, 443, 538

[56] References Cited

UNITED STATES PATENTS

| | | | |
|---|---|---|---|
| 2,952,299 | 9/1960 | Finke | 156/498 |
| 3,591,168 | 7/1971 | Zodrow | 156/571 |
| 3,660,204 | 5/1972 | Wesselmann et al. | 156/227 |
| 3,833,446 | 9/1974 | Class | 156/498 |

*Primary Examiner*—Caleb Weston
*Attorney, Agent, or Firm*—Burgess, Dinklage & Sprung

[57] ABSTRACT

In the method of applying glued labels to continuously advancing bottles or the like, wherein a pickup member is successively brought into contact with a glue applying means, the topmost label of a stack and a gripper carried by a cylinder for receiving the glued label and placing it on the bottle, the improvement which comprises folding over by 180° that marginal area of each label which is later to be gripped by the gripper, folding being effected while the label is carried by the pickup member. This is accomplished by having the pickup member pick up the label in such manner that the forward marginal area is free. Two bending members are positioned between the stack of labels and the gripper and they successively act on the free marginal area of the label to bend it 90° each time. Thus the gripper grabs the label where it is doubled and this reinforcement reduces the likelihood of tearing.

2 Claims, 1 Drawing Figure

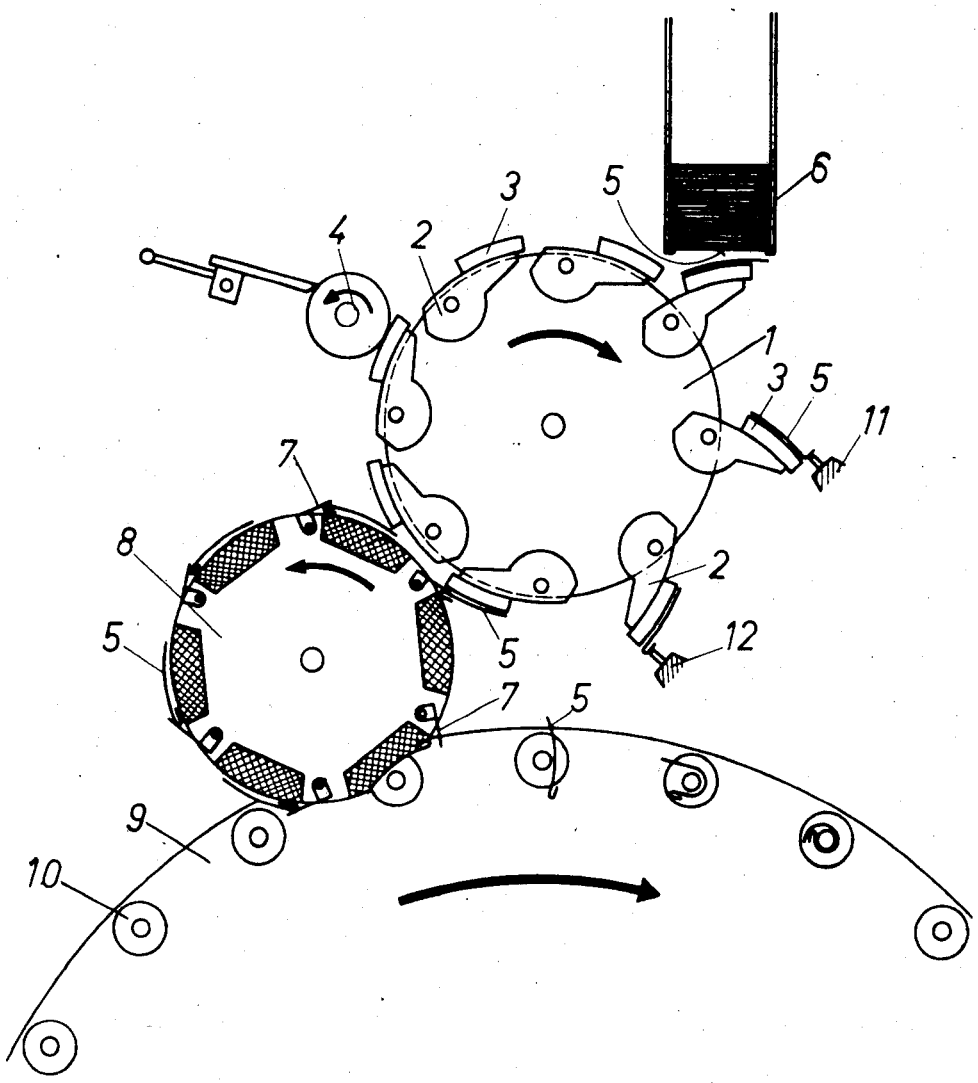
6
5
3
2
4
1
3
5
11
7
8
2
5
5
12
7
5
9
10

METHOD FOR THE APPLICATION OF GLUED LABELS TO BOTTLES OR THE LIKE

The invention relates to a method of applying glued pieces of foil to continuously advancing bottles or the like, a pickup member being brought into contact successively with a glue applying means, a label stack and a gripper cylinder applying the glued foil to the bottle. The invention additionally relates to an apparatus for the practice of the method.

Machines for wrapping bottle necks or bottle heads with metal foil have become known in which the individual pieces of foil are removed from a stack or drawn from a supply roll and severed, in order then to be brought within reach of the bottleneck by reciprocated tools after glue has been applied. Aside from the fact that the machine handling of the delicate cut foil labels presents difficulties in singling them and conveying them, the discontinuous manner of operation of the individual devices limits the output of the machine.

In the processing of such delicate metal foils on high output machines in which the singled piece of foil has glue applied to it and is then seized by continuously rotating gripper cylinders and applied to the likewise continuously advancing bottle, it has been found that the delicate metal foil fails to withstand the mechanical stresses when it is seized by the grippers and stripped away from the glue applying means, and it tears.

For this reason it has been necessary to use heavier foils, which has resulted on the one hand in considerably greater material expense, and on the other hand has made it more difficult to wrap the foil about the bottle neck and then smooth it down.

The object of the invention is the creation of a method, and of an apparatus for the practice of this method, by means of which it will be possible to work with thin metal foils on high output machines without difficulty or damage.

Making use of an apparatus in which a pickup member is brought into contact successively with a glue applying means, a stack of labels, and a gripper cylinder which places the glued label on the bottle, it is proposed in accordance with the invention, for the solution of this problem that, between the removal of the piece from the stack and its transfer to the gripper cylinder, the marginal area of the piece which faces in the direction of advancement and which is going to be seized by the grippers be folded back by 180°, the piece picked up from the stack being applied to the glue coated pickup member in such a manner that the marginal area of the piece facing in the direction of transport extends beyond the associated front edge of the pickup member, and this unglued marginal area is folded back upon the remaining portion of the piece.

In the apparatus for the practice of this method, the arrangement is made such that the glued pickup member is shorter in the direction of its rotatory movement than the label, and that bending and folding members extending into the path of movement of the label are provided for the folding back of the marginal area of the label extending beyond the front edge of the pickup member. The arrangement is furthermore made such that two bending and folding members are arranged successively in the path of the movement of the label, the first member — the bending member — engaging the projecting marginal area of the foil and bending it back by about 90°, while the second member — the folding member — folds the marginal area back by approximately 90° more.

The advantages achieved with the invention lie primarily in the fact that, both as regards the method and as regards the apparatus, the requirements are met for working thin metal foils on modern high-output machines, it being possible to use systems of the prior art which serve for the labeling of bottles or the like, preferably those operating on the rotational principle. Another important advantage consists in the fact that high-output labeling systems of this kind may be equipped with only slight modifications for the application of foil sheets to bottle necks and bottle tops.

The subject matter of the invention will be described hereinbelow with reference to the accompanying drawing which is a schematic plan view of the important parts of the apparatus.

Referring now more particularly to the drawing, the apparatus consists essentially of a continuously rotating carrier 1 on which the pickup members 3 fastened to the levers 2 are disposed, a glue applying means 4, a magazine 6 receiving the cut labels 5, a gripper cylinder 8 provided with grippers 7, and a conveying means 9 which bears the bottles 10 for foil wrapping, and which also advances continuously.

The manner of operation of the apparatus is as follows: By the rotational movement of the carrier 1 the pickup members 3 are carried past the glue applying means 4 and are provided with glue. In the area of the magazine 6 the glued pickup members 3 move out of their rotational path and by performing a rolling movement they remove the foremost foil piece 5 from the magazine 6. As the carrier 1 continues to move, the pickup members 3 return to their rotational path. In this movement the marginal area of piece 5 extending beyond the pickup member 3 is first turned up by the bending member 11, and is then completely folded over by the folding member 12. After the pickup member 3 with the piece 5 thereon has returned to its path of rotation, the now folded and hence doubled marginal area of piece 5 is seized by the grippers 7 of the revolving gripper cylinder 8 and stripped from the pickup member 3, so that the glued side of the piece 5 faces outwardly. By the rotatory movement of the gripper cylinder 8 the piece 5 thus prepared is brought into the path of movement of the bottles 10 and, upon being released by the grippers 7, is applied laterally to the neck of the bottle 10. Thereupon the bottle 10 is turned such that the adhering piece 5 faces in the direction of movement of the bottle 10, and then the piece 5 is wrapped in a known manner and by known means about the neck of the bottle, pressed down and smoothed.

Thus, the grippers 7 engage a double thickness of foil which, because of its doubled strength, is less likely to tear under the gripping stress.

It will be appreciated that the instant specification is set forth by way of illustration and not limitation, and that various modifications and changes may be made without departing from the spirit and scope of the present invention.

What is claimed is:

1. In the method of applying glued thin foil-like labels to continuously advancing bottles or the like, wherein a pickup member is successively brought into contact with a glue applying means, the topmost label of a stack thin foil-like labels and a gripper carried by a cylinder for receiving a glued label and placing it on the bottle, the improvement which comprises folding over by 180° that marginal area of each label which is later to be gripped by the gripper, folding being effected while the label is carried by the pickup member.

2. The method of claim 1, wherein the pickup member contacts the label in such fashion that the marginal area of the label projects beyond the pickup member and this marginal area is folded back upon the remaining portion of the label.

* * * * *